US008887676B2

(12) United States Patent
Methley et al.

(10) Patent No.: US 8,887,676 B2
(45) Date of Patent: Nov. 18, 2014

(54) CAMSHAFT AND PHASER ASSEMBLY

(75) Inventors: Ian Methley, Long Hanborough Witney (GB); Richard Alwyn Owen, Oxfordshire (GB)

(73) Assignee: Mechadyne PLC, Kirtlington, Oxfordshire (GB)

( * ) Notice: Subject to any disclaimer, the term of this patent is extended or adjusted under 35 U.S.C. 154(b) by 280 days.

(21) Appl. No.: 13/145,103

(22) PCT Filed: Jan. 27, 2010

(86) PCT No.: PCT/IB2010/050357

§ 371 (c)(1),
(2), (4) Date: Dec. 6, 2011

(87) PCT Pub. No.: WO2010/086799

PCT Pub. Date: Aug. 5, 2010

(65) Prior Publication Data

US 2012/0067310 A1 Mar. 22, 2012

(30) Foreign Application Priority Data

Jan. 30, 2009 (GB) ..... 0901478.8

(51) Int. Cl.

| | |
|---|---|
| ***F01L 1/34*** | (2006.01) |
| ***F01L 1/047*** | (2006.01) |
| *F01L 1/344* | (2006.01) |

(52) U.S. Cl.

CPC ..... *F01L 1/047* (2013.01); *F01L 2001/34493* (2013.01); *F01L 1/3442* (2013.01); *F01L 2001/0473* (2013.01)

USPC ..... 123/90.17

(58) Field of Classification Search

USPC ..... 123/90.15, 90.17, 90.6; 464/160, 161; 29/888.1

See application file for complete search history.

(56) References Cited

U.S. PATENT DOCUMENTS

| | | | | |
|---|---|---|---|---|
| 7,284,517 | B2 * | 10/2007 | Lancefield et al. | 123/90.17 |
| 7,866,293 | B2 * | 1/2011 | Clever et al. | 123/90.6 |
| 2009/0314235 | A1 * | 12/2009 | Rozario et al. | 123/90.17 |

* cited by examiner

*Primary Examiner* — Thomas Denion
*Assistant Examiner* — Daniel Bernstein
(74) *Attorney, Agent, or Firm* — Allen, Dyer, Doppelt, Milbrath & Gilchrist

(57) ABSTRACT

An assembly is disclosed which comprises an SCP camshaft 130 and a phaser mounted at one end of the SCP camshaft. The phaser has a stator 112 driven by an engine crankshaft and two output members 114, 116 each fast in rotation with a respective one of the inner shaft 140 and the outer tube 126 of the SCP camshaft 130. Two timing features 160, 172 are provided for enabling respective sensors to determine the angular positions of the inner shaft and the outer tube of the SCP camshaft. In the invention, both timing features 160, 172 are located on the side of the stator 112 remote from the camshaft 130.

7 Claims, 3 Drawing Sheets

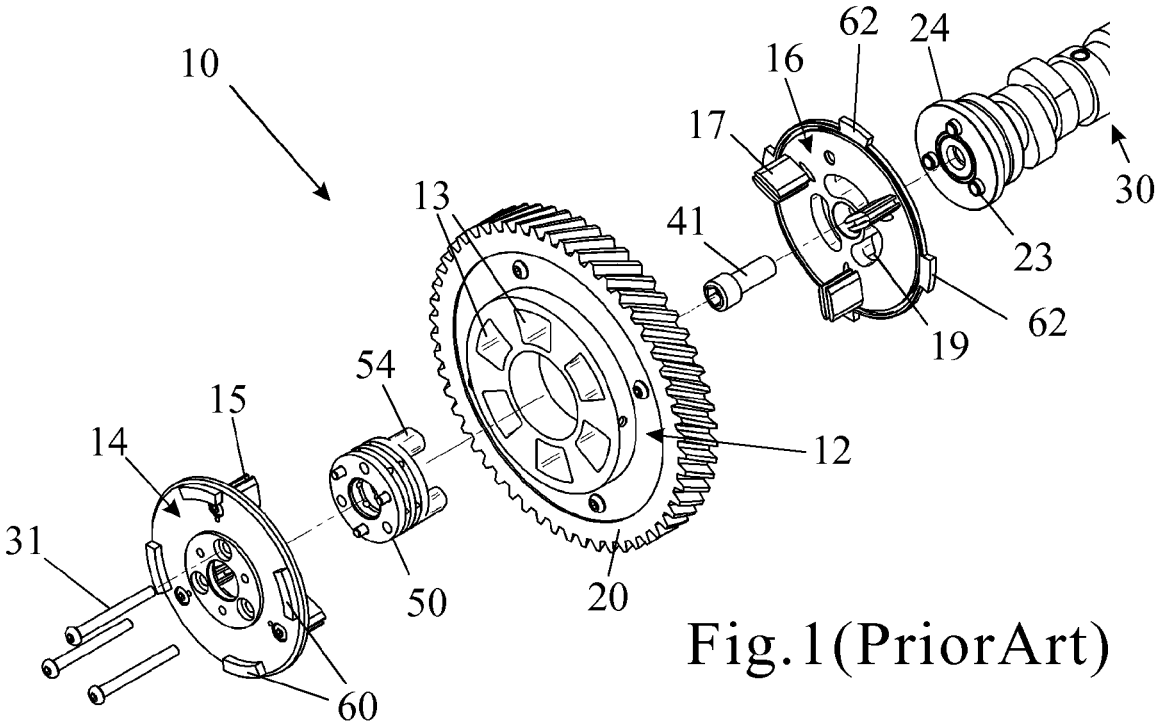
Fig.1(PriorArt)
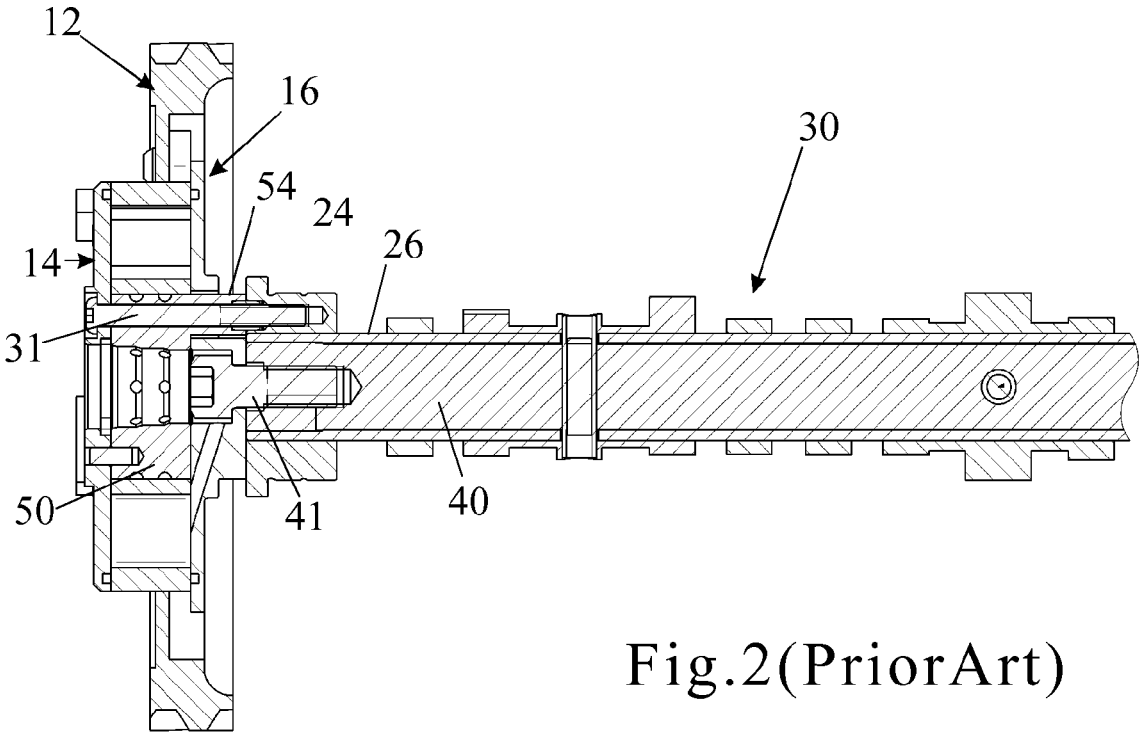
Fig.2(PriorArt)

CAMSHAFT AND PHASER ASSEMBLY

FIELD OF THE INVENTION

The present invention relates to a camshaft having an inner shaft and an outer tube that are rotatable relative to one another, a first set of cams secured for rotation with the outer tube, and a second set of cams rotatably mounted on the outer tube and connected for rotation with the inner shaft by way of pins that pass with clearance through circumferentially elongated slots in the outer tube, and a phaser mounted at one end of the camshaft.

BACKGROUND OF THE INVENTION

Assembled camshafts are known, for example from WO2008/075094, GB 2424258 and EP 1362986, which comprise an inner shaft and an outer tube that are rotatable relative to one another. A first set of cams is secured for rotation with the outer tube while a second set of cams is rotatably mounted on the outer tube and is connected for rotation with the inner shaft by way of pins that pass with clearance through circumferentially elongated slots in the outer tube. Such a camshaft, which allows the relative phase of cams rotatable about a common axis to be changed, is referred to herein as an SCP camshaft.

There are also known hydraulically operated vane-type cam phasers that are intended to drive an SCP camshaft, an example of such is a phaser as disclosed in U.S. Pat. No. 6,725,817. Such phasers will herein be referred to as twin phasers, because they have two output members, one for driving the inner shaft of the SCP camshaft and the other for driving its outer tube. The phase of both of the output members are adjustable hydraulically relative to the engine crankshaft, such as by controlling the flow of oil under pressure to arcuate working chambers arranged on opposite sides of radial vanes connected to a respective one of the output members. This could equally be achieved with two single phasers arranged in series or parallel, attached to the front of the SCP camshaft.

A known SCP camshaft and twin phaser assembly based on the disclosure of WO2008/075094 and believed to represent the closest prior art will now be described with reference to the accompanying FIGS. 1 and 2, in which FIG. 1 shows an exploded view of the twin phaser and the front end of the camshaft while FIG. 2 shows an axial view through the twin phaser when assembled on the camshaft.

In the twin phaser 10 of FIGS. 1 and 2, the phase of each of two output members, formed as end plates 14, 16, is adjustable relative to the engine crankshaft. The phaser has a stator 12 formed as a gear 20 to be driven by the engine crankshaft. If the phaser is chain driven, the gear 20 would be replaced by a sprocket. The stator 12 is annular and has six arcuate recesses 13. Three of the recesses receive vanes 15 projecting from the front end plate 14 and the other three receive vanes 17 projecting from the rear end plate 16.

The camshaft 30 terminates within a front bearing 24 which is formed with three screw threaded holes receiving ring dowels 23 and is fast in rotation with the outer tube 26 of the camshaft 30.

The twin phaser 10 is supported on a bearing support 50 which comprises a ring with three axially projecting hollow legs 54. The ring 50 is engaged in use by an oil feed spigot that projects from a cover overlying the front end of the engine block. The front cover may, for example, be an adaptation of that described in GB-A-2,329,675. The stator 12 of the twin phaser is in turn supported by the radially outer surface of the support bearing 50 and can rotate through only a few degrees relative to it. Various passageways and oil grooves in the support bearing 50 allow oil from the engine front cover to be supplied under pressure to the working chambers of the twin phaser 10.

The legs 54 of the support bearing 50 pass through three arcuate clearance slots 19 formed in the rear end plate 16 to contact the axial end face of the bearing 24 that is mounted on the outer tube 26 of the SCP camshaft 30. The bearing support 50 is axially clamped between the front plate 14 of the twin phaser 10 and the bearing 24 by means of three bolts 31 which pass through the hollow legs 54 and clamp the front end plate 14, the support bearing 50 and the bearing 24 to one another. This ensures that the front end plate 14 is fixed both axially and rotationally in relation to the outer tube 26 of the SCP camshaft 30.

Additionally, the hollow legs 54 of the support bearing 50 are aligned in relation to the bearing 24 by means of the ring dowels 23 that project from the axial end surface of the bearing 24 into the hollow legs 54 of the support bearing 50.

The rear end plate of the twin phaser 10 is directly secured onto the inner shaft 40 of the SCP camshaft 30 by means of a bolt 41 that is screw threaded into a bore in the axial end face of the inner shaft 40.

In the above described assembly, the two output members of the twin phaser are arranged one at the front, namely the end plate 14, and the other at the rear, namely the end plate 16. In an internal combustion engine, it is necessary to sense the angular position of these output members so that the electronic engine control unit (ECU) can correctly control camshaft timing.

Though not specifically described in WO2008/075094, the front and rear output members produced by the present Applicants did in practice have timing features on them, for triggering adjacently mounted sensors. In FIG. 1, the timing feature on the front plate 14 comprises four axially projecting teeth 60 and that on the rear plate comprises four radially projecting teeth 62. The sensors need to be positioned next to these timing features in such a way that electrical sensor signals are generated, which can be used by the ECU to control the phaser 10.

SUMMARY OF THE INVENTION

According to the present invention, there is provided an assembly as described above in which both the timing features rotatable in unison with the respective output members of the phaser are located on the side of the stator remote from the camshaft.

As earlier mentioned, timing features 60 and 62 were used in a twin phaser of the type shown in WO2008/075094 on both the front and the rear output member. While a sensor can readily be mounted to interact with the timing feature 60 on the front output member 14, the rear output member 16 is relatively inaccessible. It is consequently difficult to position a sensor to interact with the timing feature 62 on the rear output member 16 without significant modification to the cylinder block or cylinder head.

The present invention mitigates this problem by locating the timing features that indicate the angular positions of both output members on the front side of the phaser, that is to say the side remote from the camshaft, where they are readily accessible.

In a preferred embodiment of the invention, the stator is supported on a bearing which is connected for rotation with the outer tube and one of the timing features. A second co-axial inner sleeve is connected for rotation with the inner shaft and the other of the timing features.

Conveniently, the phaser is constructed as a vane-type twin phaser, the output members being formed by the two end plates of the phaser. In such a case, the rear end plate of the phaser is advantageously connected directly to the outer tube of the SCP camshaft.

The timing feature indicating the angular position of the rear end plate of the phaser is preferably formed as a separate trigger ring located at the front end of the phaser, the trigger ring, the support bearing and the rear end plate being clamped to the front of the camshaft.

The rear face of the trigger ring may in such a construction serve to control the internal clearance between the moving plates within the phaser.

It is furthermore possible for a space between the trigger ring and the front end plate of the phaser to be sealed so as to define a hydraulic cavity which, when pressurised, applies a force to reduce clearances within the phaser.

BRIEF DESCRIPTION OF THE DRAWINGS

The invention will now be described further, by way of example, with reference to the accompanying drawings, in which:

FIG. 1 is an exploded view of a prior art assembly of the type known from PCT/GB2007/050736, FIG. 2 is a cut-away direct view of a prior art assembly of the type known from PCT/GB2007/050736, show in FIG. 1.

DETAILED DESCRIPTION OF THE PREFERRED EMBODIMENTS

Figure 3:
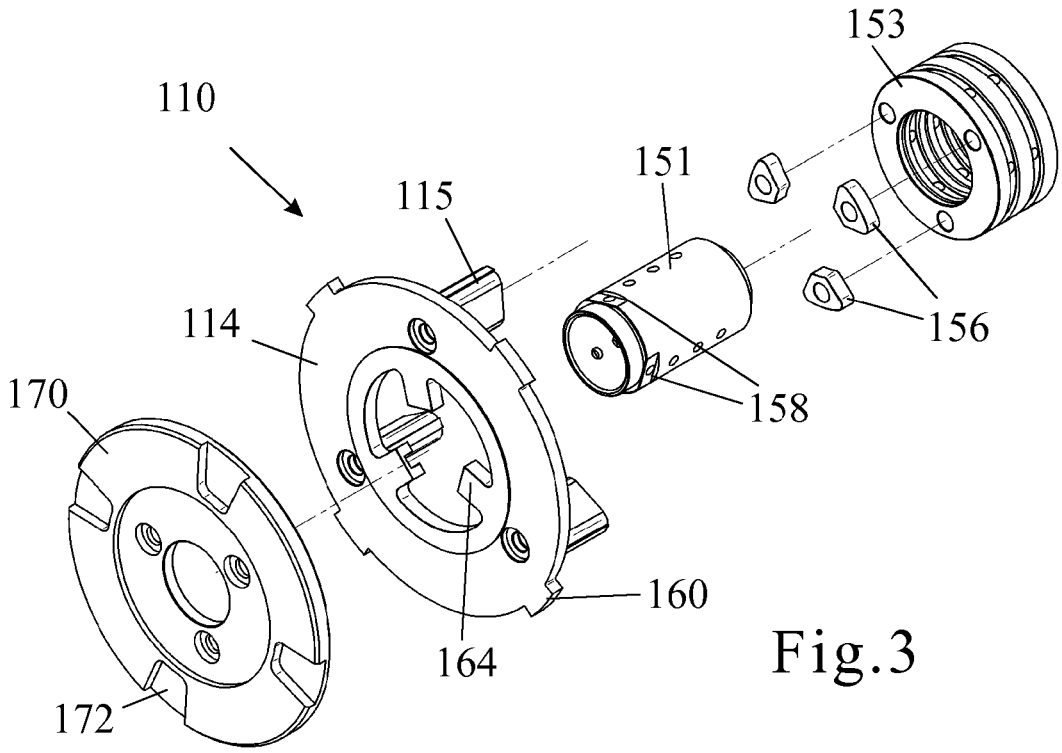
FIG. 3 is a partial exploded view of an assembly of the invention showing only the trigger ring, the front end plate, the inner co-axial sleeve of the phaser and the support bearing for the phaser.
Figure 4:
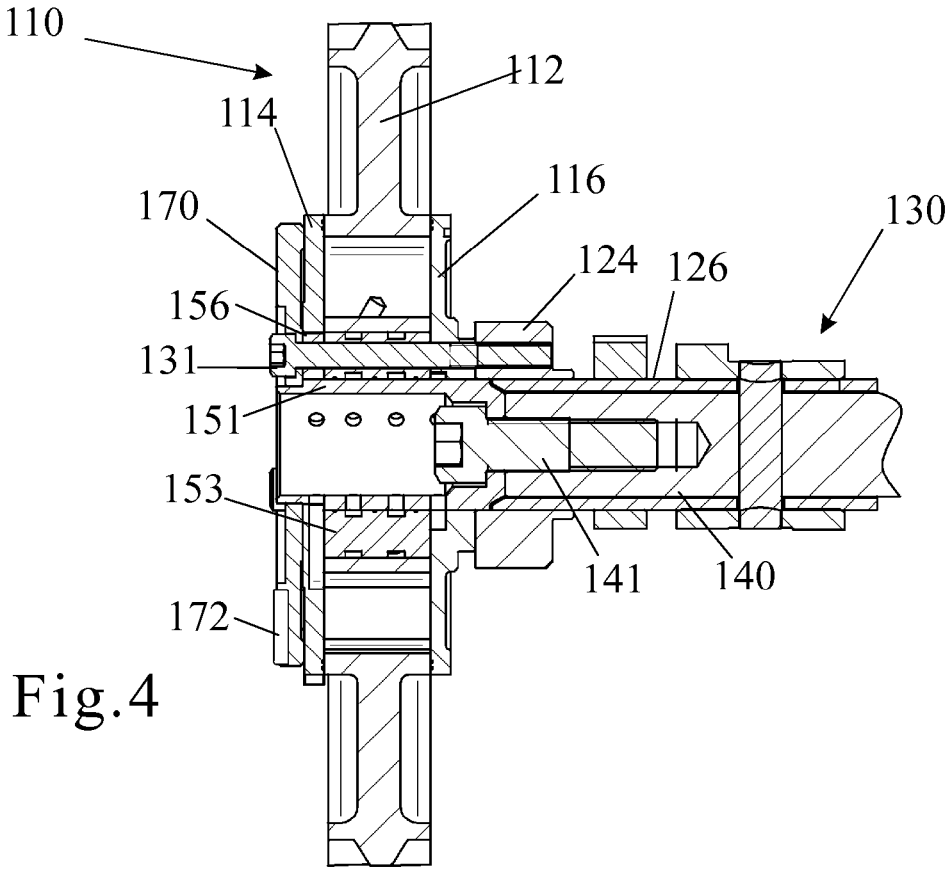
FIG. 4 is an axial section showing the same embodiment of the invention as shown in part in FIG. 3.

In FIGS. 3 and 4, components identical to those earlier described with reference to FIGS. 1 and 2, or serving a similar function, have been allocated the same reference numerals as previously but in the "100" series. In the same way, the embodiment of FIG. 5 has been allocated reference numeral in the "200" series.

FIG. 3 does not show the stator 112, nor the back plate 116 of the phaser 110 but these are shown in FIG. 4. In place of the single piece support bearing 50 of FIGS. 1 and 2, the embodiment of the invention shown in FIGS. 3 and 4 has a support bearing 153 does not have any protruding legs and an inner sleeve 151 is arranged within the support bearing 153 is. Both of these components are formed with passageways for supplying oil to the working chambers of the vane type phaser in the same way as described in PCT/GB2007/050736. In particular, a front cover fitted to the engine has a stationary projecting spigot that fits within the inner sleeve 151 and is sealed relative to it by suitable rotary seals.

As compared with FIGS. 1 and 2, the embodiment of the invention shown in FIGS. 3 and 4 reverses the manner in which the end plates 114 and 116 are coupled to the SCP camshaft 130. In particular, the front end plate 114 is coupled for rotation with the inner shaft 140 of the SCP camshaft, while the rear end plate 116 and a trigger ring 170 are clamped for rotation with the outer tube 126 of the camshaft 130. In both cases, as will now be described, the connection is made via either the support bearing 153 or the inner sleeve 151.

Three screw threaded bolts 131 are engaged in threaded holes in the front camshaft bearing 124, which is mounted on the outer tube 126 of the camshaft 130. The bolts 131 pass first through the trigger ring 170, then through spacers 156, then holes in the support bearing 153 and finally through holes in the rear end plate 116 before being screwed into the camshaft bearing 124. When the bolts 131 are tightened, they clamp the trigger ring 170, the support bearing 153, the rear end plate 116 and the camshaft bearing 124 for rotation with one another but, because of the spacers 156, the front end plate 114 can rotate relative to all these components and also relative to the stator 112.

The inner sleeve 151 is secured by a bolt 141 to the inner shaft 140 of the camshaft 130 and the front end plate has three radially inwardly projecting fingers 164 which engage with flats 158 on the outer surface of the inner sleeve 151. As a result, the front end plate 114 rotates in unison with the inner sleeve 151 and the inner shaft 140 of the camshaft 130.

The trigger ring 170 has a timing feature in the form of recesses 172 which indicates the angular position of the outer tube 126 of the camshaft 130. Likewise, the front end plate 114 has a timing feature in the form of radial teeth 160 which indicates the angular position of the inner shaft 140 of the camshaft 130. Unlike the prior art, both timing features are accessible from the front side of the phaser, that is to say the side remote from the camshaft 130.

The important differences between the preferred embodiment of the invention and the prior art are the following:

- The inclusion of an inner sleeve 151 which connects the front end plate 114 to the inner shaft 140 of the camshaft 130.
- The provisions of a front trigger ring 170 that is clamped to the support bearing 153 via spacers 156, the spacers 156 being needed to ensure the front plate 114 is not clamped to the support bearing 153. It should be noted in this respect that the spacers could alternatively form an integral part of the trigger ring 170 or the support bearing 153.
- The rear end plate 116 is clamped between the support bearing 153 and the front cam bearing 124.

As well as overcoming the problems associated with sensing the angular position of both the front and rear end plates of the phaser, the embodiment of FIGS. 3 and 4 offers the following advantages:

- Simplified design of the support bearing 153 (just a simple cylinder).
- Simplified design of the rear phaser end plate 116, which is clamped directly to the front cam bearing 124.
- Better alignment with the camshaft 130 because the inner sleeve 151 locates on the inner diameter of the front cam bearing 124.

Figure 5:
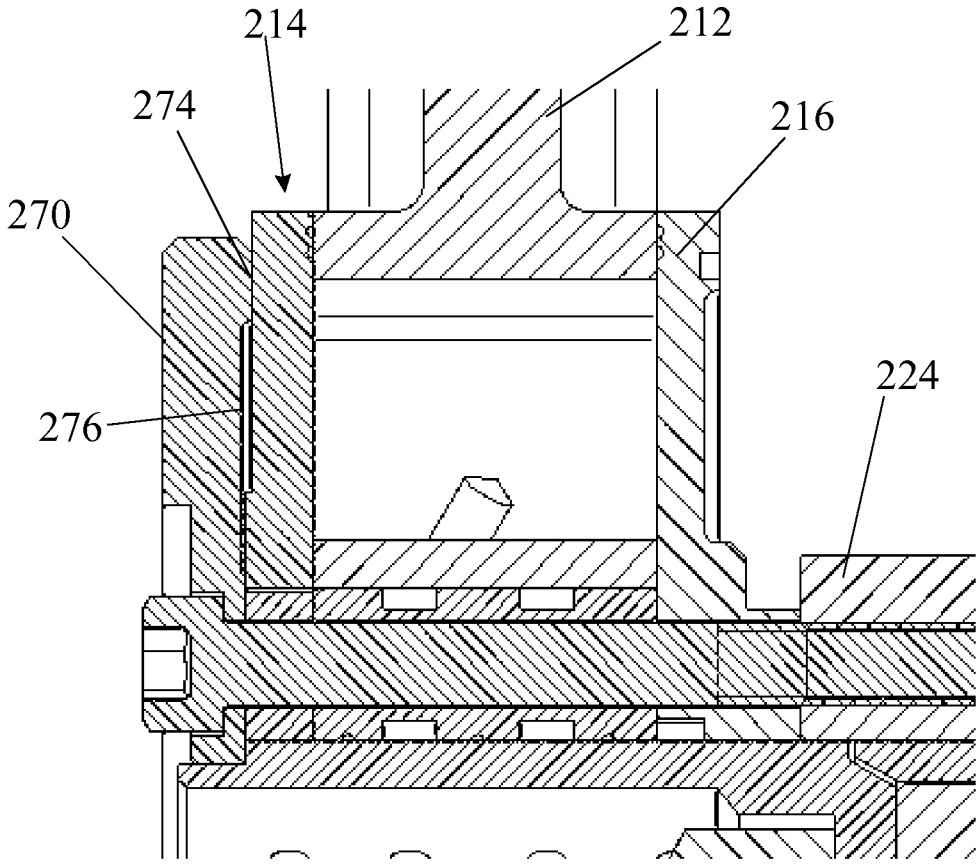
FIG. 5 is a close-up section similar of FIG. 4 for the description of an alternative embodiment of the invention.

FIG. 5 shows a modification of the assembly of FIGS. 3 and 4. In this embodiment, the front trigger ring 270 is sealed at 274 relative to the front end plate of the phaser 214 to define a cavity 276. Pressurised oil is allowed to pass into the cavity 276. Because the trigger ring 270 is clamped to the cam bearing 224, pressure in the cavity 276 forces the front end plate 214 and the stator 212 rearwards onto the rear plate 216. This has the net effect of reducing the clearances within the phaser, reducing internal leakage and hence improving overall performance.

We claim:

1. A camshaft comprising an inner shaft and an outer tube that are rotatable relative to one another, a first set of cams secured for rotation with the outer tube, and a second set of cams rotatably mounted on the outer tube and connected for rotation with the inner shaft by way of pins that pass with clearance through circumferentially elongated slots in the outer tube, and a phaser mounted at one end of the camshaft, wherein the phaser has a stator connectible for rotation with an engine crankshaft and two output members each mounted for rotation in unison with a respective one of the inner shaft and the outer tube of the camshaft, the output members having timing features rotatable in unison therewith for enabling respective sensors to determine the angular positions of the inner shaft and the outer tube of the camshaft, and wherein both the timing features rotatable in unison with the respective output members of the phaser are located on the same side of the stator remote from the camshaft, the timing features on the same side of the stator being rotatable relative to each other.

2. The camshaft of claim 1, wherein the stator is supported on a support bearing which is connected for rotation with the outer tube of the camshaft and one of the timing features, the support bearing having a co-axial inner sleeve connected for rotation with the inner shaft of the camshaft and the other of the timing features.

3. The camshaft of claim 2, wherein the phaser is vane-type twin phaser, the output members being formed by two end plates of the phaser.

4. The camshaft of claim 3, wherein the rear end plate of the phaser is connected directly to the outer tube of the camshaft.

5. The camshaft of claim 4, wherein the timing feature indicating the angular position of the rear end plate of the phaser is formed as a separate trigger ring located at the front end of the phaser remote from the camshaft; the trigger ring, the support bearing and the rear end plate being clamped to the front of the camshaft.

6. The camshaft of claim 5, wherein the rear face of the trigger ring serves to control the internal clearance between the end plates of the phaser.

7. The camshaft of claim 6, wherein a space between the trigger ring and the front end plate of the phaser is sealed to define a hydraulic cavity which, when pressurised, applies a force to reduce clearances within the phaser.

* * * * *